US009700471B2

(12) United States Patent
Nakamura

(10) Patent No.: US 9,700,471 B2
(45) Date of Patent: Jul. 11, 2017

(54) WHEELCHAIR MOVEMENT ASSISTANCE DEVICE

(71) Applicant: Masayoshi Nakamura, Nagano (JP)

(72) Inventor: Masayoshi Nakamura, Nagano (JP)

( * ) Notice: Subject to any disclaimer, the term of this patent is extended or adjusted under 35 U.S.C. 154(b) by 0 days.

(21) Appl. No.: 14/400,492

(22) PCT Filed: Mar. 12, 2013

(86) PCT No.: PCT/JP2013/001581
§ 371 (c)(1),
(2) Date: Nov. 11, 2014

(87) PCT Pub. No.: WO2013/171949
PCT Pub. Date: Nov. 21, 2013

(65) Prior Publication Data

US 2015/0121656 A1 May 7, 2015

(30) Foreign Application Priority Data

May 13, 2012 (JP) ..... 2012-110149

(51) Int. Cl.
*A45C 13/26* (2006.01)
*A61G 5/10* (2006.01)
(Continued)

(52) U.S. Cl.
CPC ..... *A61G 5/10* (2013.01); *A61G 5/003* (2013.01); *A61G 5/06* (2013.01); *Y10T 16/466* (2015.01)

(58) Field of Classification Search
CPC ..... Y10T 16/4713; Y10T 16/4719; Y10T 16/473; Y10T 16/476; Y10T 16/469;
(Continued)

(56) References Cited

U.S. PATENT DOCUMENTS 730,119 A * 6/1903 Hanson et al. ..... E04C 5/10 248/78
4,240,184 A * 12/1980 Delhees ..... F16G 11/04 24/279
(Continued)

FOREIGN PATENT DOCUMENTS

GB 1272148 A * 4/1972 ..... B62B 5/04
JP 1991-067621 U1 11/1989
(Continued)

OTHER PUBLICATIONS

International Search Report, PCT/JP2013/001581, Apr. 16, 2013, 4 pages.

*Primary Examiner* — Chuck Mah
(74) *Attorney, Agent, or Firm* — Ogilvie Law Firm

(57) ABSTRACT

This wheelchair movement assistance device comprises: a pair of mounting members which is mounted to the left and right front pipes or the left and right leg pipes of a wheelchair in a removable manner by being clamped or engaged therewith; and a square C-shaped pipe frame, to both ends of which the pair of mounting members is mounted. The mounting members are provided with clamping sections formed at the ends of pipe frame, and with grasping sections attached to the ends of the pipe frame at positions in front of the clamping sections. Each of the grasping sections grips a portion of each of the front pipes of the wheelchair or a portion of each of the leg pipes of the wheelchair, and each of the clamping sections is in pressure contact with a portion of each of the front pipes or the leg pipes of the wheelchair.

3 Claims, 6 Drawing Sheets

(A)

(B)

(51) Int. Cl.
*A61G 5/00* (2006.01)
*A61G 5/06* (2006.01)

(58) Field of Classification Search
CPC ... Y10T 16/498; Y10T 16/466; Y10T 294/00; Y10T 294/902; B65G 7/02; B65G 7/12; B65G 49/061; B62B 2205/006; B62B 5/06; B62B 5/065; B62B 5/067; B62B 5/068; B62B 9/20; B62B 9/206; B62B 11/00; B62B 1/14; A61H 3/00; A01B 1/026; A61G 5/00; A61G 5/003; A61G 5/027; A61G 5/068; A61G 5/10; B25G 1/00; B25G 1/04
See application file for complete search history.

(56) References Cited

U.S. PATENT DOCUMENTS 4,360,213 A * 11/1982 Rudwick ..... A61G 5/00 16/35 D
4,671,522 A * 6/1987 Fragione, Jr. ..... B62B 5/068 188/119
4,748,994 A * 6/1988 Schultz ..... A61H 3/04 135/67
5,168,889 A * 12/1992 Diestel ..... A47C 7/66 135/161
5,222,567 A 6/1993 Broadhead et al.
5,269,044 A * 12/1993 Marion ..... B25G 3/38 114/362
5,470,093 A * 11/1995 Kiser ..... A61G 5/10 280/304.1
5,482,304 A * 1/1996 Smith ..... B62K 27/003 280/204
6,098,492 A * 8/2000 Juchniewicz ..... B62B 5/064 280/47.371
6,415,475 B1 * 7/2002 Dixon ..... B60D 1/00 16/110.1
6,550,104 B2 * 4/2003 Cacciacarne ..... B62B 5/06 16/426
7,032,974 B1 * 4/2006 Berger ..... A61G 5/12 297/398
7,240,403 B1 * 7/2007 Richardson ..... A47J 45/10 16/110.1
7,290,776 B2 * 11/2007 Pascznk ..... B62B 5/06 280/47.371
7,500,689 B2 * 3/2009 Pasternak ..... A61G 5/10 280/250.1
7,971,914 B1 * 7/2011 Pladson ..... A01B 1/026 16/426
8,042,849 B2 * 10/2011 Pratt ..... B65G 7/12 294/19.3
8,177,248 B2 * 5/2012 Rousseau ..... A61G 5/061 280/250.1
8,627,550 B1 * 1/2014 Chung ..... A47J 37/0786 16/422
8,714,171 B1 * 5/2014 Haygood ..... A61G 7/1038 135/66
8,893,355 B2 * 11/2014 Longley ..... B25G 1/00 16/426
2004/0046342 A1 * 3/2004 Lin ..... B62B 1/12 280/47.17
2009/0313791 A1 * 12/2009 Takemura ..... F16M 3/00 16/429
2012/0017394 A1 * 1/2012 Junk ..... B62B 5/067 16/349

FOREIGN PATENT DOCUMENTS

JP 2004-135747 A 5/2004
JP 3114363 U 7/2005
JP 3116351 U 9/2005
JP 2006-101955 A 4/2006
JP 2007-125202 A 5/2007
JP 2008079768 A * 4/2008
JP 3147551 U 10/2008
JP 2010-115239 A 5/2010
JP 2012-035833 A 2/2012

* cited by examiner (A)

(B)

(A)

(B)

WHEELCHAIR MOVEMENT ASSISTANCE DEVICE

TECHNICAL FIELD

The present invention relates to a wheelchair movement assistance device which supports emergency evacuation at the time of disaster or the like as well as traveling and movement on rough terrain such as a sandy area, a snowy road, a gravel road and a swampy area or on ascending slopes.

BACKGROUND ART

There is known a wheelchair movement assistance system in which a tow carriage which moves along a previously set guide is used to safely tow a wheelchair to a destination. (See Patent literature 1)

There is also known a manually moving vehicle which is provided with a seat portion which is supported by way of a plate spring on a supporting shaft for supporting wheels on both sides and a steering rod which tows the seat portion, in which the seat portion has a chair-type seat pipe frame to which a seating member, a back rest member and a foot rest member are mounted. (See Patent literature 2)

Further, there is known a simple connection type of wheelchair tow carriage which does not require a large-scale connection device but can be easily connected manually by a wheelchair user personally and also can be traveled at a safe speed if operated by a handicapped person who has troubles moving fingers or hands. (See Patent literature 3)

Still further, there is known a rotationally movable arm-equipped wheelchair in which a care provider is able to smoothly move a wheelchair on which a care-needing person sits when going up and down a slope or when traveling on a rough place such as a gravel road. (See Patent literature 4)

However, in the case of the wheelchair movement supporting system which has been disclosed in the Patent Document 1, there is used a tow carriage which moves along a previously set guide. Therefore, the system has difficulty in dealing with emergency evacuation at the time of disaster or the like and also to travel on rough terrain such as a sandy area, a snowy road, a gravel road and a swampy area or on ascending slopes.

Further, the manually moving vehicle having a seat pipe-frame which has been disclosed in the Patent Document 2 has difficulty in being applied to a general-use wheelchair.

Still further, the simple connection type of wheelchair tow carriage which has been disclosed in the Patent Document 3 needs power supply from a battery. Therefore, the carriage is unable to tow a wheelchair if the battery is not charged, which poses a problem.

In addition, in the case of the rotationally movable arm-equipped wheelchair which has been disclosed in the Patent Document 4, a wheelchair is modified so that a rotationally movable arm is constantly kept attached and the wheelchair is attached so as to move rotationally in relation to a wheelchair main-body in a front back direction. This wheelchair can be folded but not handled in a similar manner as a generally-used wheelchair, which poses a problem.

In the case of requiring large-scale emergency evacuation such as the Great East Japan Earthquake or in the case of moving on rough terrain such as a sandy area, a snowy road, a gravel road and a swampy area or moving on ascending slopes, it is quite difficult to move a wheelchair by pushing a grip portion (grip) at the rear.

The wheelchair movement supporting device is required to be attached to a general-use wheelchair simply and within a short period of time when emergency evacuation is needed.

Further, the wheelchair movement assistance device is required to be compactly accommodated at normal times.

PRIOR ART

[Patent literature 1] JPU-3116351
[Patent literature 2] JP2012-035833A
[Patent literature 3] JP2004-135747A
[Patent literature 4] JP2007-125202A

OUTLINE OF THE INVENTION

Problems to be Solved by the Invention

In view of the above situation, an object of the present invention is to provide a wheelchair movement assistance device which is capable of supporting emergency evacuation at the time of disaster or the like as well as traveling and movement of a wheelchair on rough terrain such as a sandy area, a snowy road, a gravel road and a swampy area or on ascending slopes and also which is attached to the wheelchair simply and within a short period of time and accommodated compactly.

Means to Solve the Objects

In order to attain the above-described object, a first aspect of the wheelchair movement assistance device of the present invention is composed of a pipe frame which is provided at one end thereof with an attachment member which is attached in a detachable manner to a front pipe or a leg pipe of a wheelchair by being attached in a holding manner or attached in a locking manner, and the wheelchair can be moved by towing the other end of the pipe frame.

Conventionally, a wheelchair is constituted so as to be supported for movement by being pushed by a care provider from behind. However, where a wheelchair is used on emergency evacuation at the time of disaster and the like or the wheelchair is used for traveling on rough terrain or on ascending slopes, in most cases, the wheelchair has difficulty in being moved only by being pushed manually from behind.

The wheelchair movement assistance device of the present invention is composed of a pipe frame which is provided at one end thereof with an attachment member which can be attached in a detachable manner to a front pipe or a leg pipe of a wheelchair by being attached in a holding manner or attached in a locking manner, and the wheelchair is towed by towing the other end of the pipe frame. Thereby, the wheelchair movement assistance device is able to easily support emergency evacuation at the time of disaster and the like or support traveling and movement on rough terrain and on ascending slopes.

In addition, the wheelchair movement assistance device is preferably constituted in pairs. According to the above constitution, the wheelchair movement assistance device is attached to the front pipes on both sides of the wheelchair or the leg pipes on both sides, and the pipe frames on both sides can be pulled to tow the wheelchair safely.

Here, the pipe frame is made of resin or metal which is light in weight. The pipe frame is formed in a cylindrical shape or a polygonal column shape which extends long. It is acceptable that the pipe frame may be curved partially. The pipe frame is provided at one end thereof with an attachment member which can be attached in a detachable manner to the front pipe or the leg pipe by being attached in a holding manner or attached in a locking manner. The pipe frame is provided at the other end thereof with a grip, a belt, a cord or the like so that a person may easily grasp it by hand. It is preferable that the other end of the pipe frame is formed in a L-letter shape, a J-letter shape or a T-letter shape, so that a person is able to easily grip the pipe frame.

The frame can be formed in a pipe shape to make lighter in weight. Further, it is preferable that the pipe frame is constituted with a plurality of pipe frame members different in diameter, a pipe frame member at each stage is provided in a nested structure, and pipe frame members at a multiple stage undergo straight expansion and contraction so as to be adjusted for its length. Where the wheelchair movement assistance device is constituted, for example, with two pipe frames different in diameter, it is constituted so that an inner diameter of one of the pipe frames is substantially equal to an outer diameter of the other of the pipe frames and the other pipe frame is able to move inside one of the pipe frames in a sliding manner.

Further, a second aspect of the wheelchair movement assistance device of the present invention is constituted with a pair of attachment members which are attached in a detachable manner to front pipes on both sides of the wheelchair or leg pipes on both sides by being attached in a holding manner or attached in a locking manner and a U-letter shaped pipe frame having the pair of attachment members on both ends thereof.

According to the above-described constitution, it is possible to safely tow a wheelchair and also possible to easily support emergency evacuation by the wheelchair at the time of disaster or the like as well as traveling and movement by the wheelchair on rough terrain and ascending slopes.

The pipe frame used in the second aspect of the wheelchair movement assistance device is constituted with two parallel pipe frames and a pipe frame connected therewith in a direction orthogonal thereto, that is, a pipe frame which assumes a U-letter shape when viewed from above. It is acceptable that the pipe frame is formed in an integral manner or in a divided manner with a plurality of pipe frames. The pipe frame is made of resin or metal which is light in weight. A rod-like member is formed in a cylindrical shape or a polygonal column shape which extends long. It is acceptable that the rod-like member is curved partially.

Here, it is acceptable that the attachment member is such that it can be attached in a detachable manner at least to the front pipes on both sides of the wheelchair or the leg pipes on both sides. For example, the attachment member may be such that it is able to hold the front pipe, etc., with two members, that is, it is able to keep the front pipe, etc., held by using fasteners such as setscrews and hooks, thereby being fixed on the front pipe, etc.

It is preferable that the attachment member used in the wheelchair movement assistance device of the present invention is constituted with a held-and-attached portion formed at an end of the pipe frame and a grip portion which is at the front of the held-and-attached portion and mounted to the end of the pipe frame in which the grip portion grips a part of the front pipe or a part of the leg pipe of the wheelchair and the held-and-attached portion is partially in pressure contact with the front pipe or the leg pipe of the wheelchair.

It is possible to attach in a detachable manner easily the wheelchair movement assistance device to a wheelchair and within a short period of time.

It is in particular preferable that the held-and-attached portion comes into contact with a position adjustment nut which is engaged with screw threads installed on the periphery of the pipe frame, thereby allowing the position adjustment nut to rotate, with a shaft center of the pipe frame given as a rotational axis, by which the held-and-attached portion moves along the shaft center of the pipe frame and is partially in pressure contact with the front pipe or the leg pipe of the wheelchair.

Further, as another aspect, the attachment member used in the wheelchair movement assistance device of the present invention is a pair of hooks, each of which is formed so as to curve along a circular arc of substantially semi-circumference in which the pair of hooks, each of which is formed so as to curve in a mutually opposing direction, are installed, with the shaft center of the pipe frame being in axial symmetry, and a fall prevention stopper which closes an opening portion of the hook is attached so as to slide in the longitudinal direction of the pipe frame.

The fall prevention stopper for closing the opening portion of the hook is installed, thus making it possible to prevent the wheelchair movement assistance device from falling off from the wheelchair.

As a still another aspect, the attachment member used in the wheelchair movement assistance device of the present invention is constituted with (a) a supporting rod and (b) a pair of hooks which are given below. The thus constituted attachment member can be easily attached in a detachable manner to the leg pipe of the wheelchair.

(a) The supporting rod which penetrates through the above-described rod-like member or the pipe frame in a direction orthogonal to the longitudinal direction of the rod-like member or the pipe frame. This supporting rod is firmly attached to an end of the rod-like member or an end of the pipe frame.

(b) The pair of hooks which are fixed to both ends of the supporting rod and each of which is formed so as to curve along a circular arc of substantially semi-circumference on a face in parallel with the cross section of the supporting rod. Each of the pair of hooks is formed so as to curve in a mutually opposing direction and a shape surrounded by the pair of hooks is substantially a circle when viewed in the longitudinal direction of the supporting rod.

The hook which locks a lower side of the leg pipe of the wheelchair is arranged so as to support the leg pipe of the wheelchair from the rear to the front. Further, the hook which locks an upper side of the leg pipe of the wheelchair is arranged so as to support the leg pipe of the wheelchair from the front to the rear.

Here, it is preferable that in addition to (a) the supporting rod and (b) the pair of hooks, (c) a stopper is also installed. The stopper is installed, by which the leg pipe of the wheelchair is connected more firmly with the wheelchair movement assistance device, thereby preventing the wheelchair movement assistance device from falling off from the leg pipe.

(c) The leg-pipe fall prevention stopper which is installed at a site where the hook for locking the lower side of the leg pipe of the wheelchair is joined to the supporting rod.

Here, the stopper is a member or a belt which closes an opening portion of the hook. It is acceptable that, for example, a hook-and-loop fastener is used to close the opening portion of the hook.

It is also preferable that the pipe frame used in the wheelchair movement assistance device of the present invention is divided into a grip frame and a pair of joint frames on both sides. The pipe frame can be divided to improve accommodation convenience. Further, the pipe frame can be divided to cope with a difference in intervals between the front pipes and the leg pipes on both sides depending on the types of wheelchairs by adjusting the length of the grip frame.

Still further, it is also preferable that the above-described joint frame is constituted with a plurality of pipe-like members, a pipe-like member at each stage is in a nested structure and pipe-like members at a multiple stage can undergo straight expansion and contraction so as to be adjusted for the length thereof. The joint frame is such that it is constituted with, for example, two pipe frames different in diameter, the inner diameter of one of the pipe frames is substantially equal to the outer diameter of the other of the pipe frames, and the other of the pipe frames is able to move in a sliding manner inside one of the pipe frames. In addition, adjustment of the length means that, for example, pins or screws are used to fix the pipe frame which moves in a sliding manner, thereby adjusting the entire length thereof in a stepwise manner.

Effects of the Invention

The present invention has such effects that it is able to safely tow a wheelchair, easily support emergency evacuation by the wheelchair at the time of disaster or the like as well as traveling and movement by the wheelchair on rough terrain and ascending slopes and also able to be easily attached to the wheelchair within a short period of time and accommodated compactly.

BEST MODE FOR CARRYING OUT THE INVENTION

Embodiments of the present invention will be described in detail below with reference to the drawings. The present invention is not limited to the following embodiment and examples of shown in the figure, and the present invention can be variously changed in design.

Embodiment 1

Figure 1:
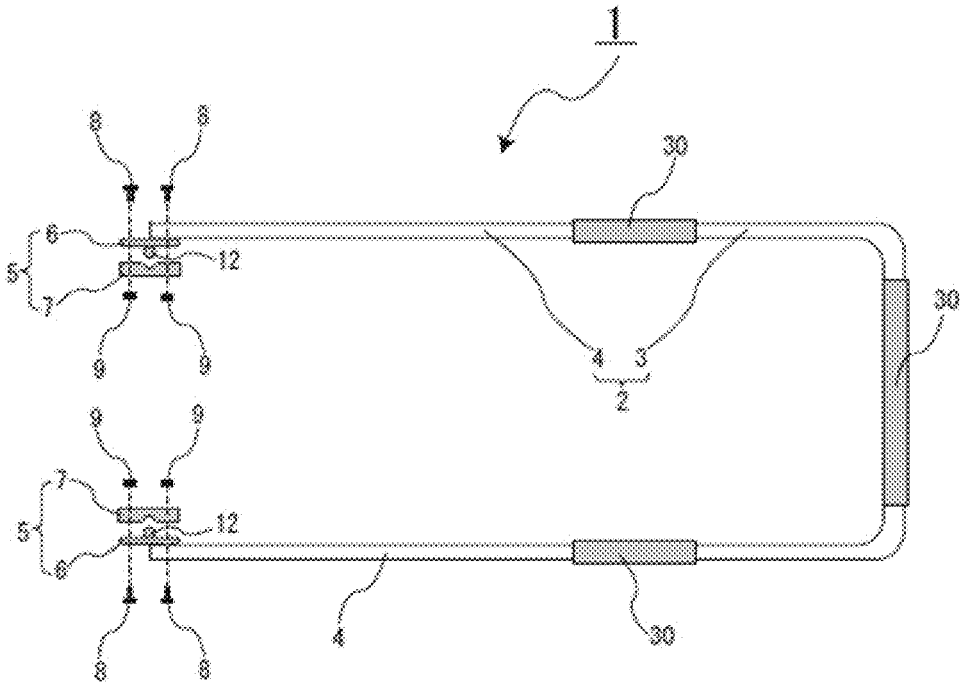
FIG. 1 shows a block diagram (plan view) of the wheelchair movement assistance device of Embodiment 1.

FIG. 1 shows a block diagram of the wheelchair movement assistance device of Embodiment 1.

A wheelchair movement assistance device 1 of Embodiment 1 is provided with a pipe frame 2 which is composed of a pipe frame of a grip frame 3 and pipe frames of two joint frames 4 as well as a pair of attachment members 5 on both sides which can be attached in a detachable manner to leg pipes 12 on both sides of a wheelchair (not illustrated). As shown in FIG. 1, the attachment member 5 is structured to hold the leg pipe 12 by using a grip portion 6, a held-and-attached portion 7, a position adjustment bolt 8 and a position adjustment nut 9, thereby attaching the leg pipe 12 in a holding manner.

The position adjustment nut 8 is engaged with screw threads installed on the periphery of the pipe frame of the joint frame 4, and the position adjustment nut 8 rotates, with the shaft center of the pipe frame given as a rotational axis, thereby moving in a sliding manner along the longitudinal direction of the pipe frame. Since the position adjustment nut 8 is in contact with the held-and-attached portion 7, the held-and-attached portion 7 will also move in association with movement of the position adjustment nut 8. The grip portion 6 is formed so as to curve along a circular arc of substantially semi-circumference and can be fitted into a part (semi-circumference) of the leg pipe 12 to grip the leg pipe 12. As described above, the leg pipe 12 is attached in a holding manner by the grip portion 6 and the held-and-attached portion 7.

Further, in FIG. 1, the leg pipe 12 is formed so as to be held between the grip portion 6 and the held-and-attached portion 7. It is, however, acceptable that in place of the leg pipe 12, the front pipe 11 is held between them so that they can be firmly attached to the front pipe 11 in a holding manner.

It is also acceptable that both the front pipe 11 and the leg pipe 12 are held between the grip portion 6 and the held-and-attached portion 7 so that they can be firmly attached to the front pipe 11 and the leg pipe 12 in a holding manner.

It is acceptable that the pipe frame 2 composed of the pipe frame of the grip frame 3 and the pipe frames of two joint frames 4 is constituted with a single pipe frame. It is also acceptable that the pipe frame 2 is such that the pipe frame of the grip frame 3 is separated from the pipe frame of the joint frame 4 and the ends of the respective pipe frames are integrally attached by using a screw or attached in a holding manner by using a held-and-attached member.

In addition, a rubber tube 30 is wound around the pipe frame 2 at three sites, with consideration given to a gripping portion by which a person tows a wheelchair.

Figure 2:
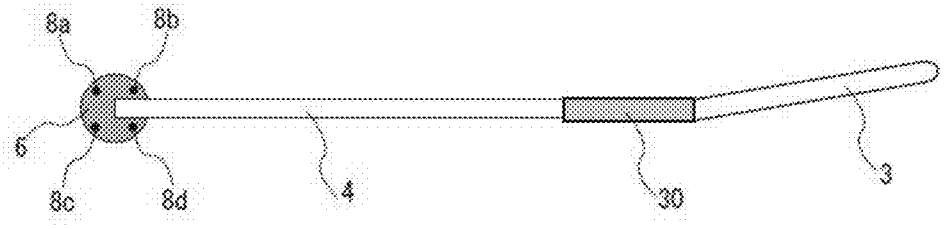
FIG. 2 shows a block diagram (front view) of the wheelchair movement assistance device of Embodiment 1.

As with FIG. 1, FIG. 2 is also a block diagram of the wheelchair movement assistance device of Embodiment 1. While FIG. 1 is a plan view, FIG. 2 is a front elevational view.

Figure 3:
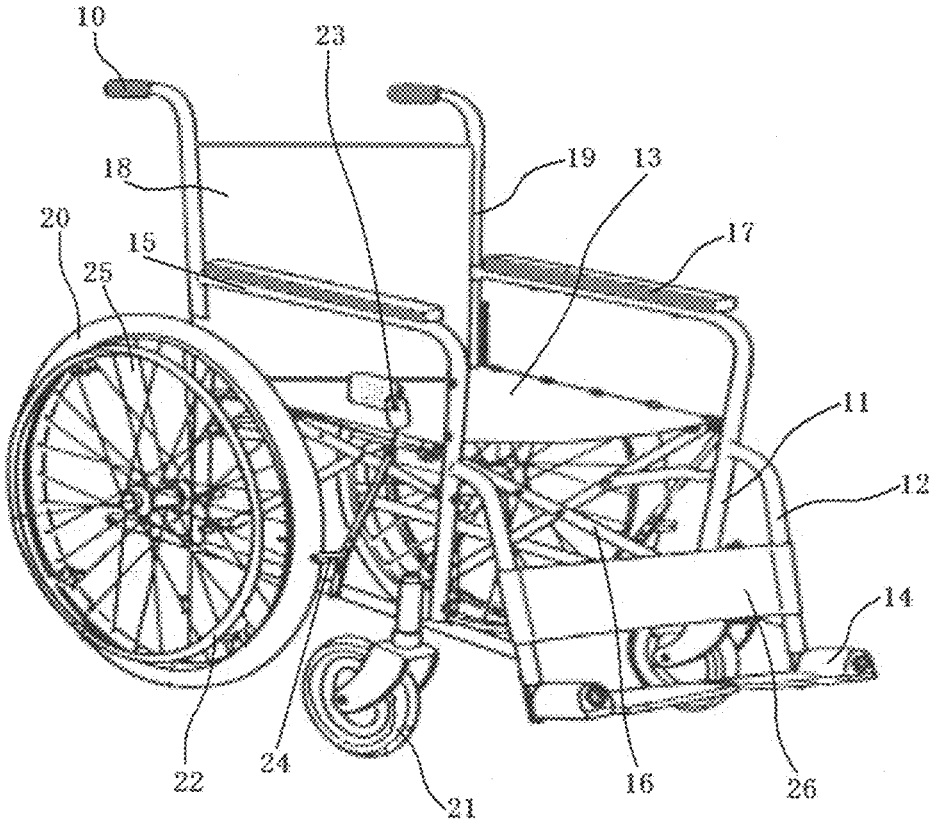
FIG. 3 shows an explanatory view of a wheelchair.

FIG. 3 is a drawing which explains a wheelchair, and the drawing is to confirm a position of the front pipe 11 and that of the leg pipe 12 in relation to the wheelchair in its entirety.

Figure 4:
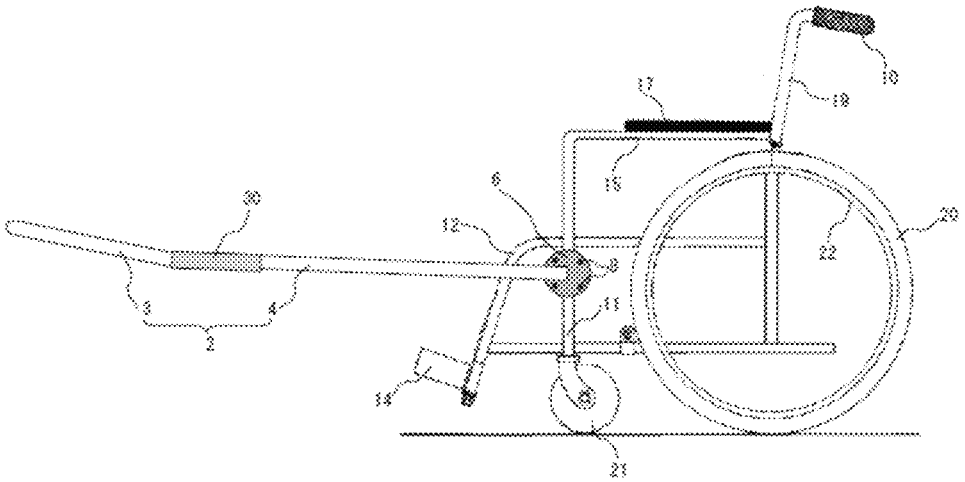
FIG. 4 shows a side view which shows an external appearance of the wheelchair to which the wheelchair movement assistance device of Embodiment 1.

FIG. 4 is a side view which shows an external appearance of the wheelchair to which the wheelchair movement assistance device of Embodiment 1 is attached. In FIG. 4, the wheelchair movement assistance device is attached to the front pipe 11.

Figure 5:
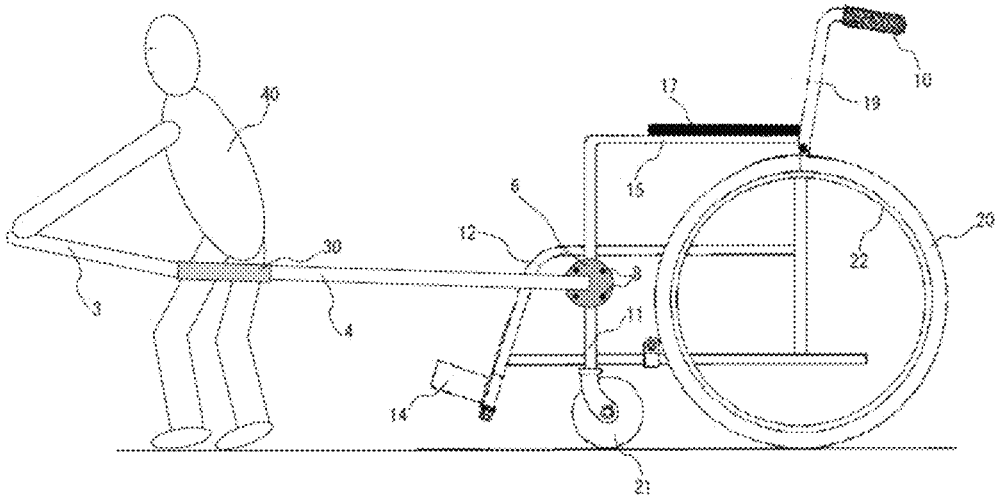
FIG. 5 shows an explanatory view of a state of using the wheelchair movement assistance device of Embodiment 1.

FIG. 5 is a drawing which explains a state of using the wheelchair movement assistance device of Embodiment 1. A person 40 who tows the wheelchair enters into a place surrounded by the pipe frame and moves forward while pushing the pipe frame of the grip frame 3. Thereby, the person is able to support traveling and movement by the wheelchair on rough terrain such as a sandy area, a snowy road, a gravel road and a swampy area and on ascending slopes. Further, the person is able to move the wheelchair on emergency evacuation at the time of disaster or the like.

It is also possible to lock a shopping basket on the two parallel joint frames 4 of the pipe frame on shopping at a supermarket. A conventional wheelchair is provided with no space for placing a shopping basket and, therefore, is inconvenient. Where a space for placing a shopping basket is provided at the rear of the wheelchair, there is a fear that the gravity point of the wheelchair moves backward from the center axis of a rear wheel (tire). Thus, it is difficult to provide the space. In the wheelchair movement assistance device of the present invention, a space is available for placing a shopping basket at the front of the wheelchair. This gives safety and assurance to a user of the wheelchair.

Further, the wheelchair movement assistance device of the present invention can be used to connect a plurality of wheelchairs. A member for locking the grip frame 3 is installed at the rear of a wheelchair, thus making it possible to connect the plurality of wheelchairs.

It is greatly advantageous that a plurality of wheelchairs can be connected and moved on emergency evacuation by wheelchairs at the time of disaster or the like.

Embodiment 2

Next, a wheelchair movement assistance device of Embodiment 2 will be described.

Figure 6:
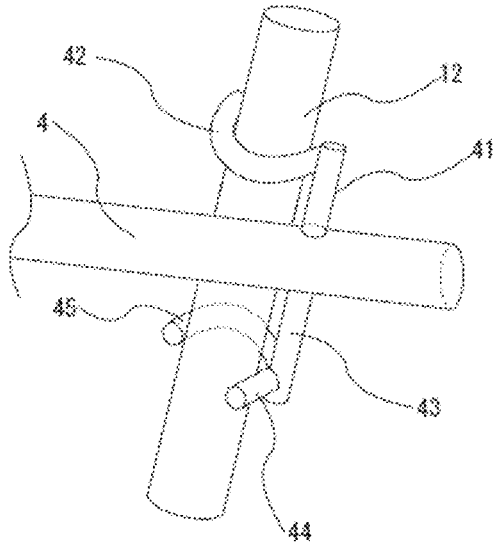
FIG. 6 shows a partially enlarged drawing which shows that a wheelchair movement assistance device of Embodiment 2 is attached to a wheelchair.
Figure 7:
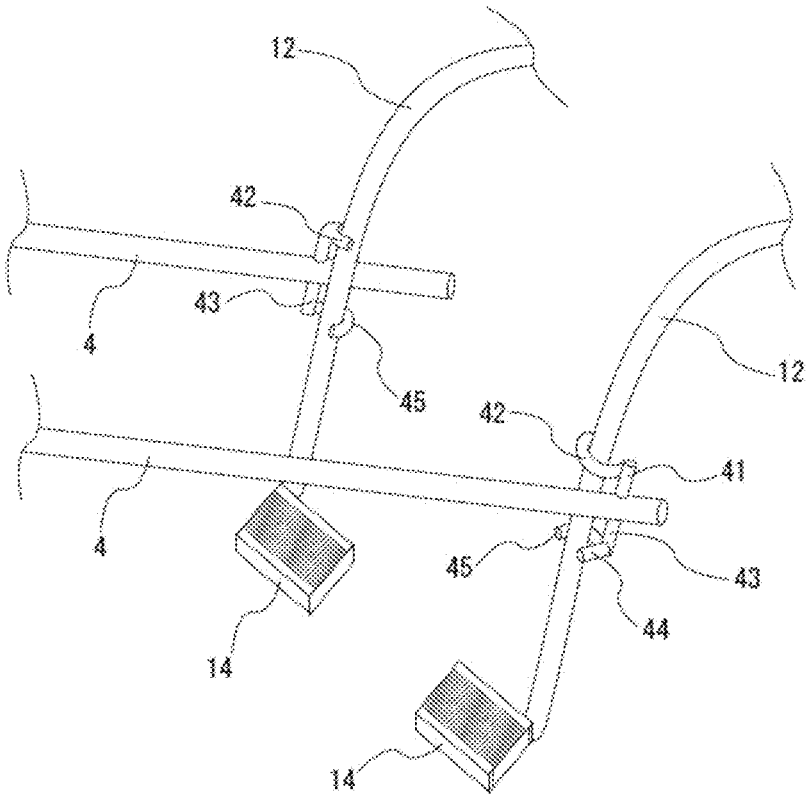
FIG. 7 shows an image drawing which shows that the wheelchair movement assistance device of Embodiment 2 is attached.

Next, FIG. 6 is a partially enlarged drawing which shows that the wheelchair movement assistance device of Embodiment 2 is attached to a wheelchair. FIG. 7 is an image drawing which shows that the wheelchair movement assistance device of Embodiment 2 is attached.

In Embodiment 2, a brief description will be given of an attachment member which can be easily attached to a wheelchair.

As shown in FIG. 6, the attachment member of Embodiment 2 is a supporting rod which penetrates a joint frame 4 in a direction orthogonal to the longitudinal direction of the joint frame 4 which constitutes a pipe frame. And, supporting rods (41, 43) are firmly attached to ends of the joint frame 4.

There are also provided a pair of hooks (42, 45) which are fixed to both ends of the supporting rods (41, 43), each of which is formed so as to curve along a circular arc of substantially semi-circumference on a face in parallel with cross section of the supporting rod (41, 43). Each of the pair of hooks (42, 45) is formed so as to curve in a mutually opposing direction. When viewed in the longitudinal direction of the supporting rods (41, 43), a shape surrounded by the pair of hooks (42, 45) is substantially in a circular shape. The leg pipe of the wheelchair is positioned at the thus surrounded part.

The hook 45 which locks a lower side of the leg pipe 12 of the wheelchair is arranged so as to support the leg pipe 12 of the wheelchair from the rear to the front. On the other hand, the hook 42 which locks an upper side of the leg pipe 12 of the wheelchair is arranged so as to support the leg pipe 12 of the wheelchair from the front to the rear.

A stopper 44 for preventing the leg pipe 12 from falling off is installed at a site where the hook 45 for locking the lower side of the leg pipe 12 of the wheelchair is joined to the supporting rod 43.

The above-described attachment member can be used to attach the wheelchair movement assistance device easily to the wheelchair.

Embodiment 3

Figure 8:
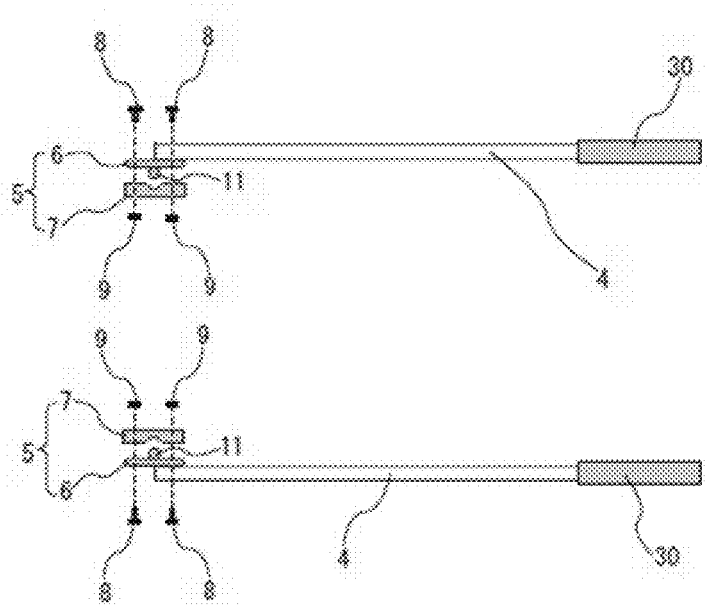
FIG. 8 shows a block diagram of the wheelchair movement assistance device of Embodiment 3.
Figure 8:
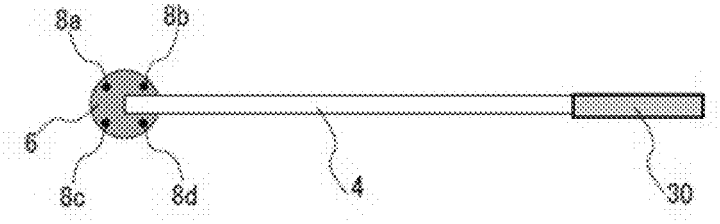

Next, a wheelchair movement assistance device of Embodiment 3 will be described. FIG. 8 shows a block diagram (A is a plan view, B is a side view which shows an external appearance) of the wheelchair movement assistance device of Embodiment 3.

The wheelchair movement assistance device of Embodiment 3 is constituted with a pipe frame of the joint frame 4 of the wheelchair movement assistance device of Embodiment 1, a pair of attachment members 5 on both sides which can be attached in a detachable manner to front pipes 11 on both sides of a wheelchair (not illustrated) and a gripping rubber tube 30. As with Embodiment 1, the attachment member 5 is able to hold the front pipe 11 or the leg pipe 12 and attach in a holding manner the front pipe 11 or the leg pipe 12 by using a grip portion 6, a held-and-attached portion 7 and a position adjustment nut 9, as shown in FIG. 8(A).

Embodiment 4

Figure 9:
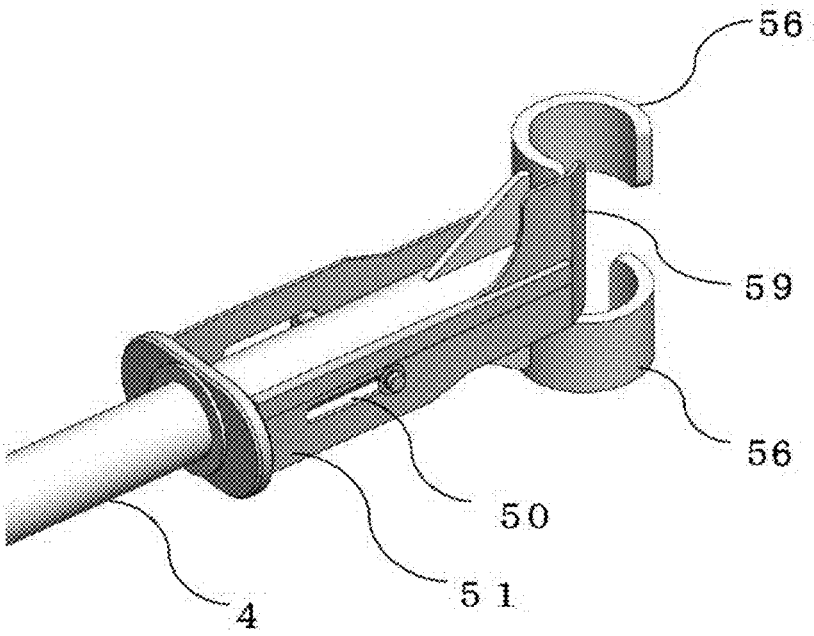
FIG. 9 shows a block diagram of the wheelchair movement assistance device of Embodiment 4.
Figure 9:
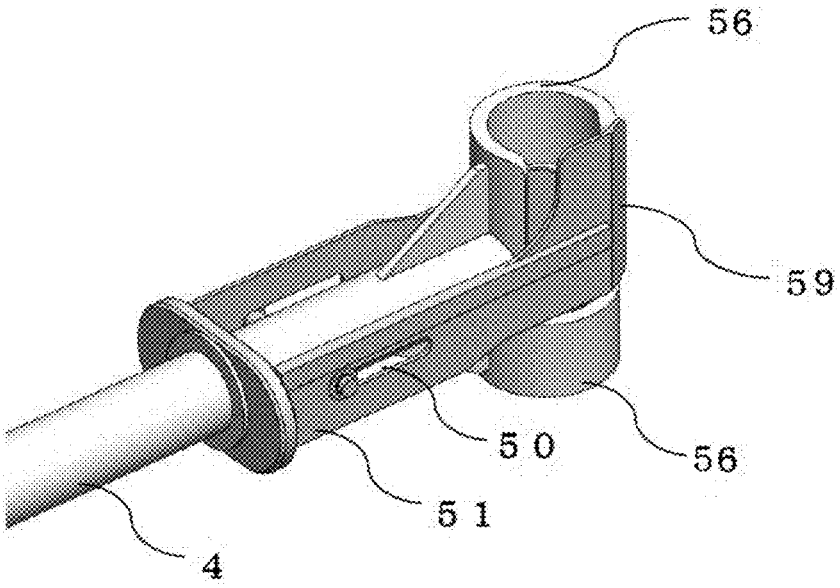

Next, a wheelchair movement assistance device of Embodiment 4 will be described. FIG. 9 shows a block diagram of the wheelchair movement assistance device of Embodiment 4.

As shown in FIG. 9, in a wheelchair movement assistance device of Embodiment 4, an attachment member is a pair of hook-like grip portions 56, each of which is formed so as to curve along a circular arc of substantially semi-circumference, the pair of hook-like grip portions 56, each of which is formed so as to curve in a mutually opposing direction, are installed, with a shaft center of a pipe frame of a joint frame 4 being in axial symmetry, and a fall prevention stopper 59 which closes an opening portion of the hook-like grip portion 56 is attached so as to slide in the longitudinal direction of the pipe frame by a sliding mechanism 50.

FIG. 9(A) is a drawing which shows a state that the opening portion of the grip portion 56 is open, and FIG. 9(B) is a drawing which shows a state that the fall prevention stopper 59 slides, by which the opening portion of the grip portion 56 is closed.

INDUSTRIAL APPLICABILITY

The present invention is usefully applicable for a wheelchair movement assistance device capable of assisting an emergency evacuation.

DESCRIPTION OF SYMBOLS

1 Wheelchair movement assistance device
2 Pipe frame
3 Grip frame
4 Joint frame
5 Attachment member
6 Grip portion
7 Held-and-attached portion
8 Position adjustment bolt
9 Position adjustment nut
10 Grip
11 Front pipe
12 Leg pipe

13 Seat
14 Foot plate
15 Arm pipe
16 Cross pipe
17 Elbow addressed
18 Back band
19 Backrest pipe
20 Rear wheel (tire)
21 Front wheel (caster)
22 Hand rim
23 Brake lever
24 Brake shoe
25 Shaft plate
26 Leg belt
30 Rubber tube
40 Person who tows the wheelchair
41, 43 Supporting rod
42, 45 Hook
44 Stopper
50 Sliding mechanism
51 Grip portion of stopper
56 Grip portion
59 Distal portion of fall prevention stopper

What is claimed is:

1. A wheelchair movement assistance device which is composed of a pipe frame which is provided at one end thereof with an attachment member which is attached in a detachable manner to a front pipe or a leg pipe of a wheelchair by clamping or engaging, in which the other end of the pipe frame can be towed to move the wheelchair, and the wheelchair movement assistance device, wherein the attachment member includes a pair of hooks, each of which is formed so as to curve along a circular arc of substantially semi-circumference, and a distal portion of a fall prevention stopper, which closes an opening portion of the pair of hooks and is attached so as to slide in the longitudinal direction of the pipe frame.

2. The wheelchair movement assistance device according to claim 1, wherein the pipe frame is constituted with a plurality of pipe frame members different in diameter, a pipe frame member at each stage is provided in a nested structure, and pipe frame members at a multiple stage undergo straight expansion and contraction so as to be adjusted for length.

3. The wheelchair movement assistance device according to claim 1, wherein the other end of the pipe frame which is opposite to one end thereof supporting the attachment member is formed in a L-letter shape, a J-letter shape or a T-letter shape.

* * * * *